US012188231B2

(12) United States Patent
Hartwick

(10) Patent No.: US 12,188,231 B2
(45) Date of Patent: Jan. 7, 2025

(54) SYSTEMS AND METHODS FOR A WALL ASSEMBLY HAVING AN ACOUSTIC PANEL

(71) Applicant: HercuTech Inc., Tempe, AZ (US)

(72) Inventor: Randall C. Hartwick, Tempe, AZ (US)

(73) Assignee: HercuTech, Inc., Tempe, AZ (US)

( * ) Notice: Subject to any disclaimer, the term of this patent is extended or adjusted under 35 U.S.C. 154(b) by 0 days.

(21) Appl. No.: 18/479,446

(22) Filed: Oct. 2, 2023

(65) Prior Publication Data

US 2024/0026682 A1 Jan. 25, 2024

Related U.S. Application Data

(62) Division of application No. 17/719,696, filed on Apr. 13, 2022, now Pat. No. 11,851,876.

(60) Provisional application No. 63/174,294, filed on Apr. 13, 2021.

(51) Int. Cl.

| | |
|---|---|
| ***E04C 2/288*** | (2006.01) |
| ***E04B 2/00*** | (2006.01) |
| ***E04C 2/38*** | (2006.01) |
| ***E04C 2/40*** | (2006.01) |
| ***E04C 2/52*** | (2006.01) |
| *E04C 2/00* | (2006.01) |

(52) U.S. Cl.

CPC ..... *E04C 2/2885* (2013.01); *E04C 2/38* (2013.01); *E04C 2/40* (2013.01); *E04C 2/46* (2013.01); *E04C 2/526* (2013.01); *E04C 2002/004* (2013.01)

(58) Field of Classification Search

CPC ..... E04C 2/38; E04C 2/40

See application file for complete search history.

(56) References Cited

U.S. PATENT DOCUMENTS

| | | | | |
|---|---|---|---|---|
| 2007/0193175 | A1 | 8/2007 | Hao | |
| 2009/0004459 | A1 | 1/2009 | Kipp et al. | |
| 2013/0025966 | A1 | 1/2013 | Nam et al. | |
| 2013/0240291 | A1 | 9/2013 | Tinianov | |
| 2016/0312468 | A1 * | 10/2016 | Lu | E04C 2/54 |
| 2019/0299577 | A1 | 10/2019 | Hill et al. | |
| 2022/0325522 | A1 | 10/2022 | Hartwick | |

FOREIGN PATENT DOCUMENTS

| | | | | |
|---|---|---|---|---|
| CA | 2882822 | A1 * | 8/2015 | E04C 2/292 |
| CA | 3045029 | A1 | 11/2018 | |
| DE | 102012208479 | A1 * | 11/2013 | E04B 1/90 |
| EP | 0747547 | A1 | 12/1996 | |
| EP | 3564508 | A1 | 11/2019 | |
| FR | 1014346 | A | 8/1952 | |
| JP | 094086 | A2 | 1/1997 | |
| WO | 2013189784 | A1 | 12/2013 | |
| WO | 2018220437 | A1 | 12/2018 | |

OTHER PUBLICATIONS

International Search Report and Written Opinion issued in corresponding Application No. PCT/US2022/024575 on Jul. 7, 2022, 9 pages.

* cited by examiner

*Primary Examiner* — Babajide A Demuren

(74) *Attorney, Agent, or Firm* — Locke Lord LLP; Joshua L. Jones

(57) ABSTRACT

Various embodiments for a wall assembly having an acoustic panel defining a plurality of thru-holes that act to break low density mechanically coupled pathways for sound transmission through the acoustic panel for reducing sound transmission are disclosed herein.

5 Claims, 17 Drawing Sheets

Drywall Vibrating Nearly In-Phase

Drywall Vibrating Out-of-Phase (180 Degrees)

SYSTEMS AND METHODS FOR A WALL ASSEMBLY HAVING AN ACOUSTIC PANEL

CROSS-REFERENCE TO RELATED APPLICATIONS

This application is a divisional of U.S. application Ser. No. 17/719,696 filed Apr. 13, 2022, which claims benefit of U.S. Provisional Application No. 63/174,294 filed Apr. 13, 2021, which is herein incorporated by reference in its entirety.

FIELD

The present disclosure generally relates to a wall assembly, and in particular to system and methods for manufacturing and assembling a wall assembly having an acoustic panel to reduce sound transmission through the wall assembly.

BACKGROUND

Current soundproofing technology used for the purpose of reducing sound transmission through wall partitions is based on four basic principles—decoupling, absorption, mass and damping. These four elements are typically increased through additive solutions, such as additional components or features having to be added to the wall assembly, to reduce sound transmission through the wall assembly. Although current soundproofing technology for conventional wall assemblies work well, they are expensive, complicated to build, and prone to human error during installation.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
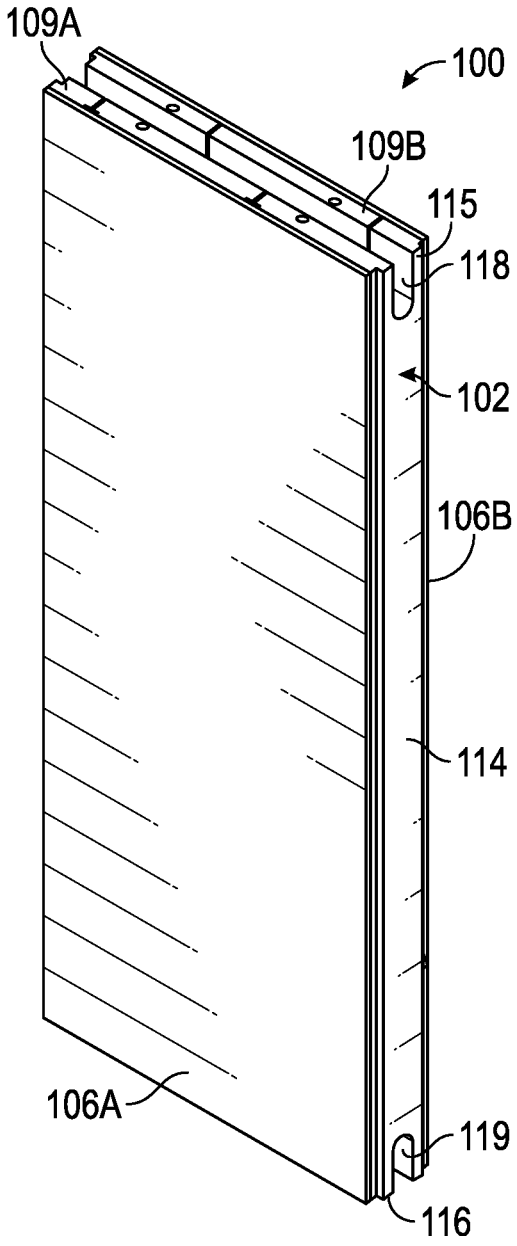
FIG. 1 is a perspective view of a wall assembly showing an acoustic panel engaged between two drywall panels.
Figure 2:
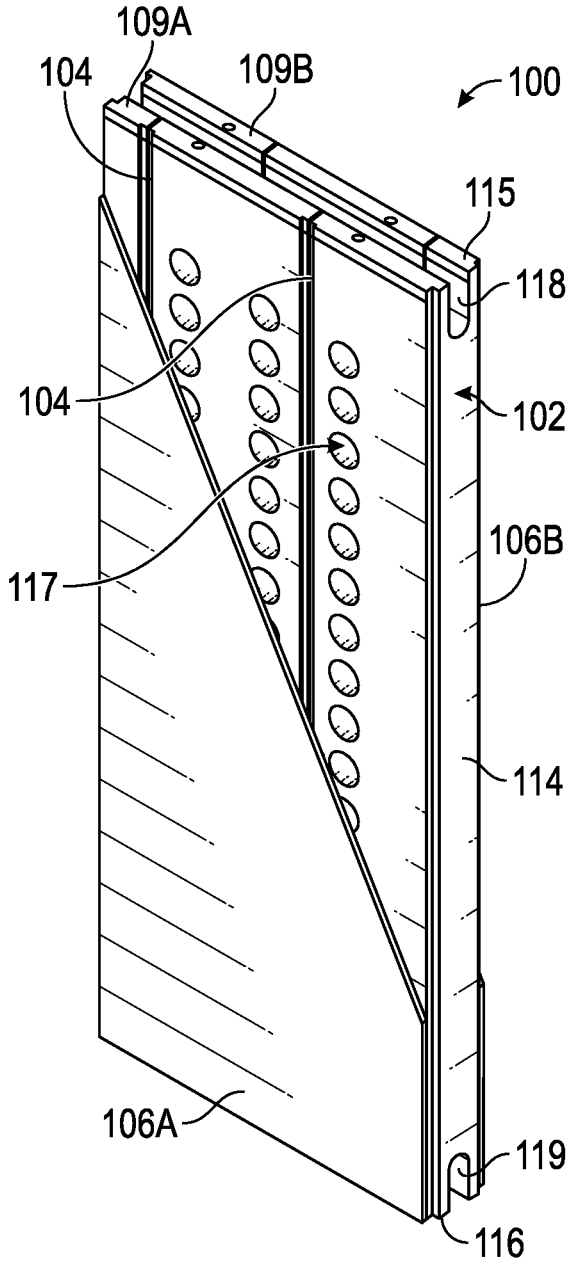
FIG. 2 is a perspective cutaway view of the wall assembly showing the acoustic panel of FIG. 1
Figure 3:
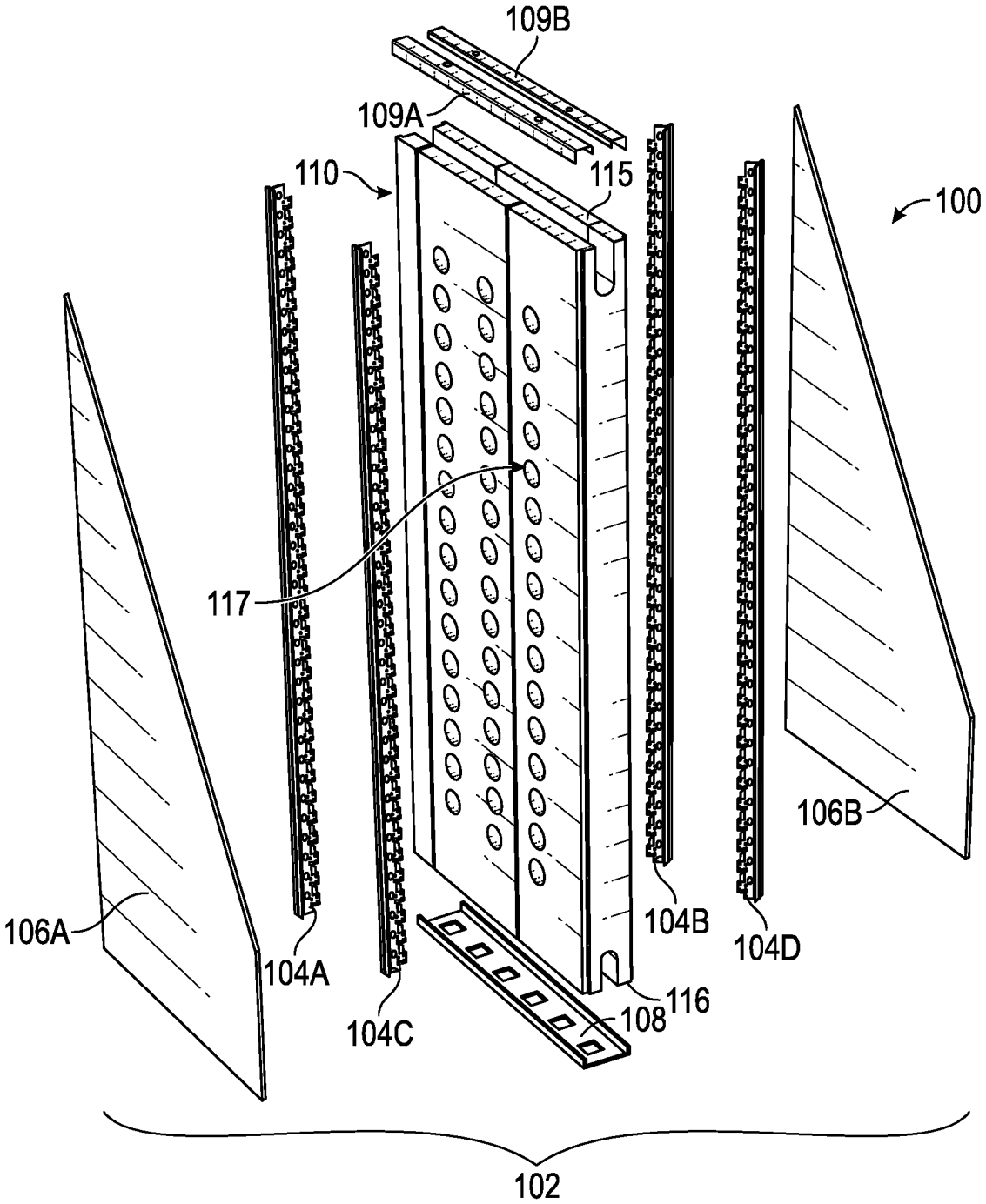
FIG. 3 is an exploded view of the wall assembly of FIG. 1.
Figure 4:
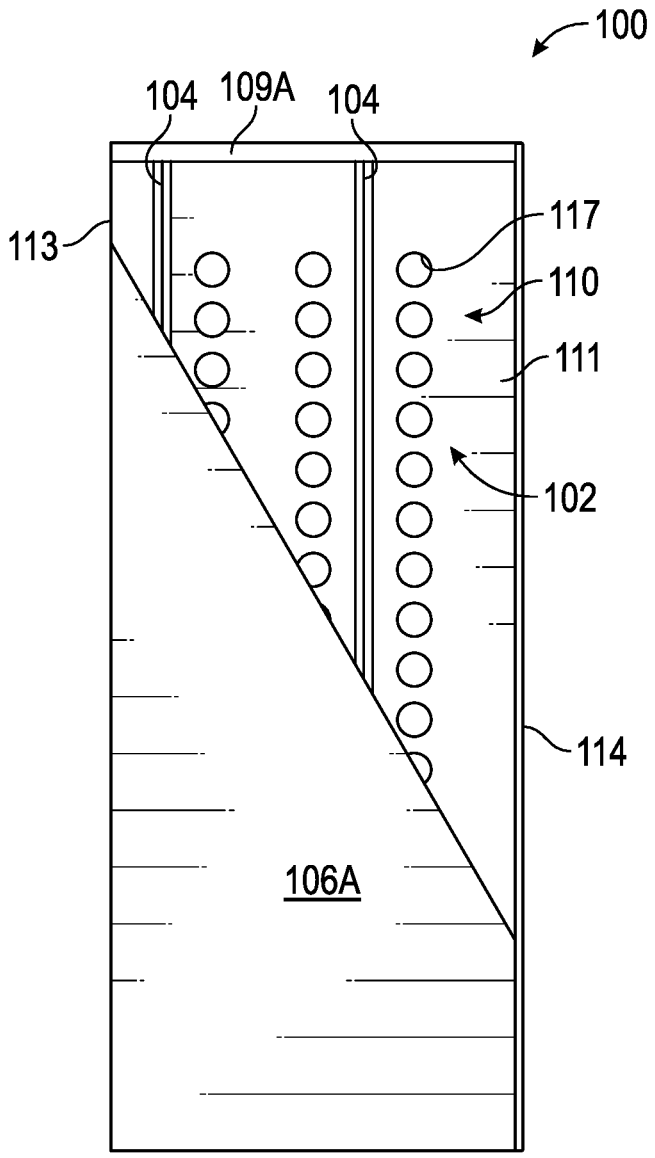
FIG. 4 is a front cutaway view of the wall assembly of FIG. 1.
Figure 5:
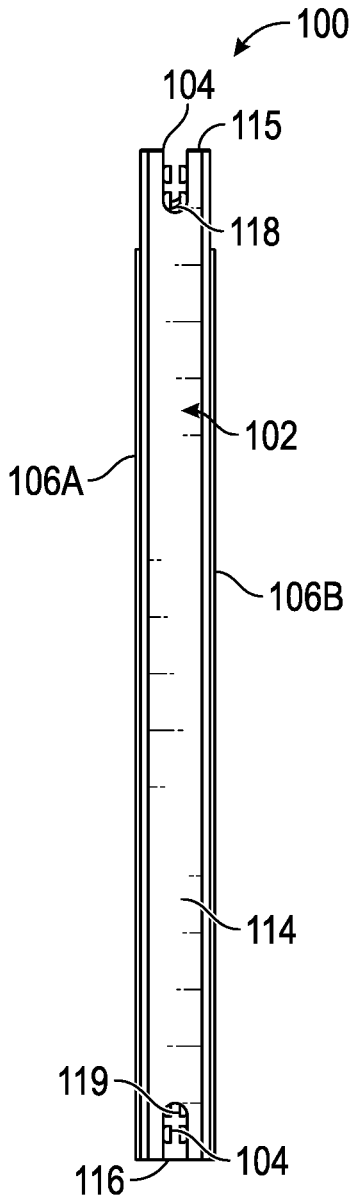
FIG. 5 is a side view of the wall assembly of FIG. 1.
Figure 6:
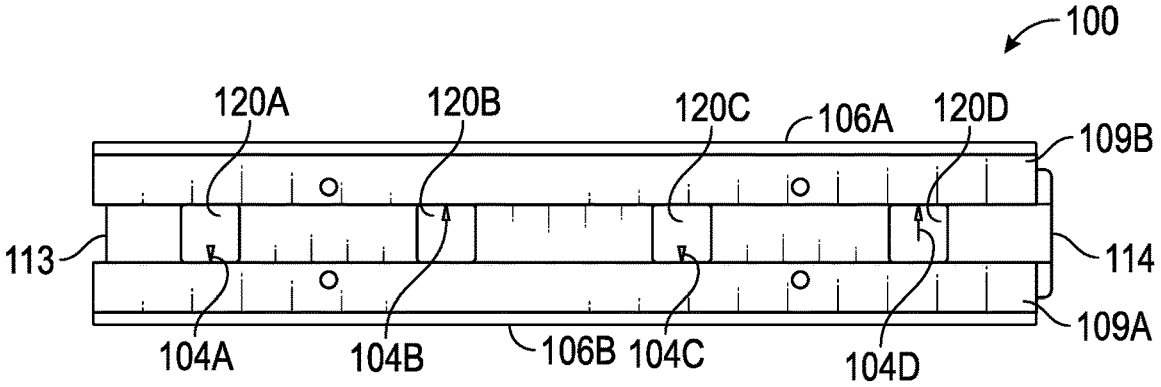
FIG. 6 is a top view of the reinforcement strip of the wall assembly of FIG. 1.
Figure 7:
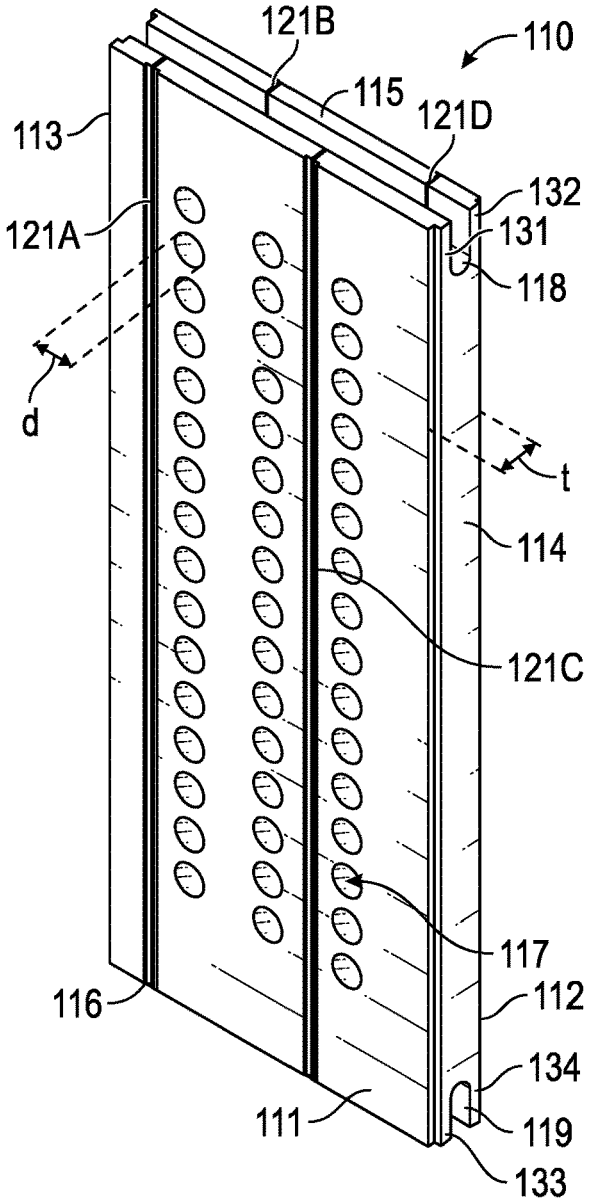
FIG. 7 is a perspective view of the wall assembly of FIG. 1.
Figure 8:
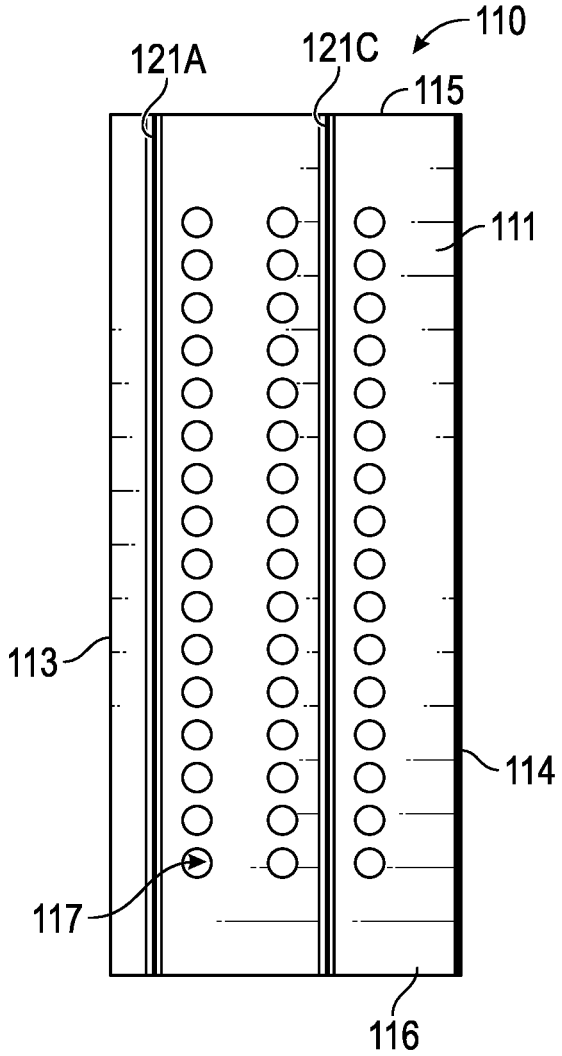
FIG. 8 is a front view of the acoustic panel of FIG. 1.
Figure 9:
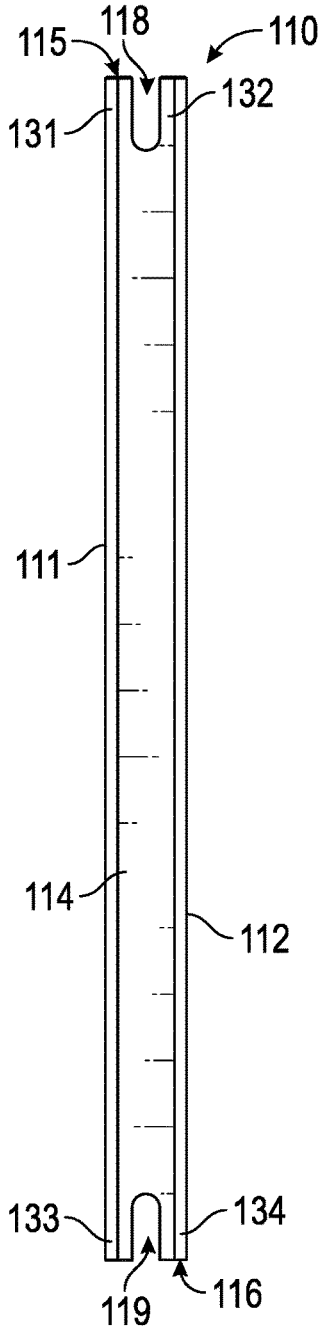
FIG. 9 is a side view of the acoustic panel of FIG. 8.

Various embodiments of a wall assembly having an acoustic panel configured for the reduction in the transmission of sound through the wall assembly are disclosed herein. In one aspect, the acoustic panel of the wall assembly is made from an expanded polystyrene (EPS) that defines a grid array of thru-holes formed through the EPS material that create a dead space when a respective drywall panel is attached to the front and rear sides of the acoustic panel. In one aspect, the dead air space created by the plurality of thru-holes reduces the internal pressure differential and vibration phase between the source side and the receiving side of the wall assembly. In another aspect, the dead space created by the plurality of thru-holes also results in the drywall panels on both sides of the acoustic panel vibrating in-phase when sound travels from the source side of the drywall panel to the receiving side of the drywall panel in order to dramatically reduce the sound transmission through the acoustic panel. In a further aspect, the plurality of thru-holes is configured to disrupt the otherwise large flat panel surface of the acoustic panel with a grid array arrangement of thru-holes that effectively reduces surface area of the acoustic panel, thereby resulting in less vibration and resonance of the sound transmission through the wall assembly.

Acoustic Panel Overview

Referring to FIGS. 1-10, an embodiment of a wall assembly 100 having an acoustic panel 102 configured to reduce sound transmission through the wall assembly 100 is disclosed. The wall assembly 100 is illustrated in FIGS. 1-6 and provides a first drywall panel 106A attached to one side of the acoustic panel 102 and a second drywall panel 106B attached to the opposite side of the acoustic panel 102 with a plurality of reinforcement strips 104A-104D engaged vertically along the acoustic panel 102 for providing structural reinforcement to the wall assembly 100 as will be discussed in greater detail below. The acoustic panel 102 notably defines a plurality of thru-holes 117 that provide "dead space" throughout the acoustic panel 102 to reduce sound transmission through sound wave disruption and decoupling between the first drywall panel 106A and the second drywall panel 106B. Further, the wall assembly 100 includes a plurality of vertical voids 120A-120D, a top horizontal void 118 and a bottom horizontal void 119 for insertion of a concrete reinforcement material to collectively form a rigid internal structure 140 (FIGS. 12-15) within the wall assembly 100.

Figure 10:
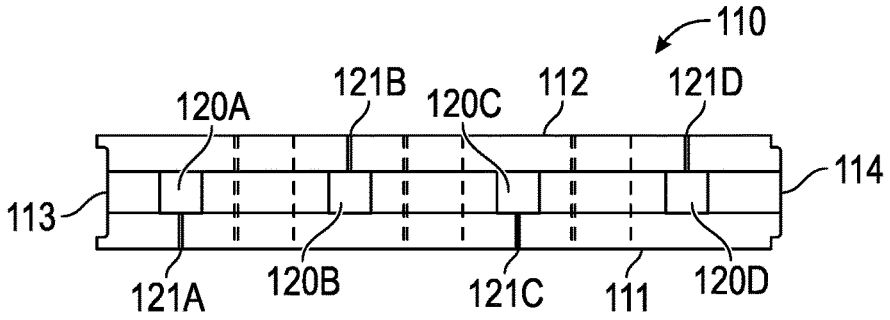
FIG. 10 is a top view of the acoustic panel of FIG. 8.
Figure 11:
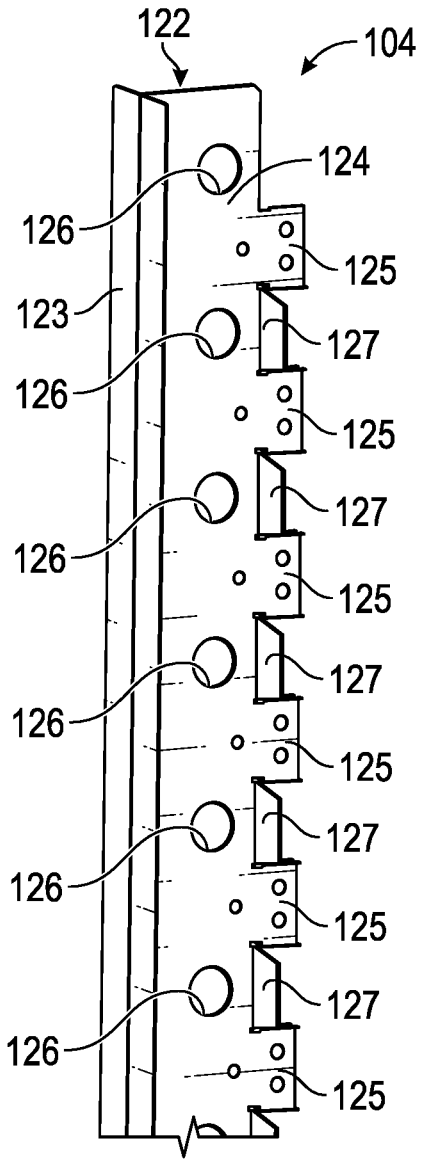
FIG. 11 is a perspective view of the reinforcement strip of the wall assembly of FIG. 8.
Figure 12:
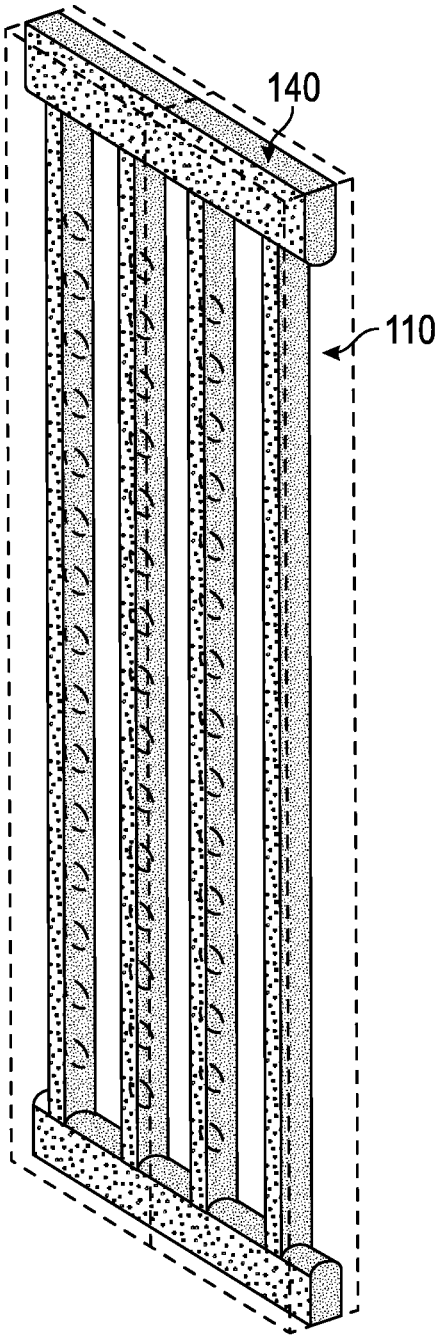
FIG. 12 is a perspective view showing internal concrete pillars with the acoustic panel of FIG. 1 in phantom.
Figure 13:
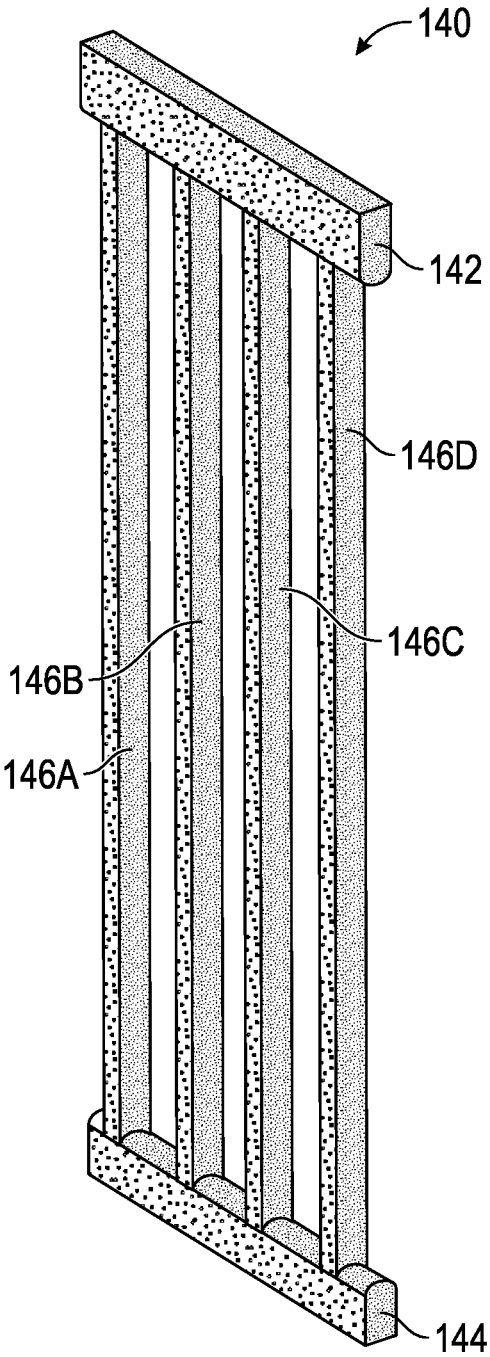
FIG. 13 is a perspective view showing the internal concrete pillars of FIG. 13.

As shown in FIGS. 3 and 7-10, the acoustic panel 102 defines a planar, rectangular-shaped panel body 110 collectively formed by a front side 111, an opposite rear side 112, a first lateral side 113, an opposite second lateral side 114, a top side 115, and a bottom side 116. In some embodiments, the bottom side 116 of the acoustic panel 102 may be mounted along a bottom track 108 for securing the acoustic panel 102 to a floor area during construction. In some embodiments, the panel body 110 of the acoustic panel 102 is made from an expanded polystyrene (EPS) material or another similar material that is lightweight and low-density. In some embodiments, a pair of top tracks 109A and 109B (collectively, top tracks 109) may be engaged to the top side 115 of the acoustic panel 102 for securing the top side 115 to the ceiling area during construction. Further, in some embodiments the acoustic panel 102 includes a plurality of vertical slits 121A-121D that respectively communicate with the plurality of vertical voids 120A-120D defined longitudinally through the panel body 110 for receipt of respective reinforcement strips 104A-104D. As shown in FIG. 10, the first lateral side 113 defines a concave surface and an opposite second lateral side 114 defines a convex surface that enable interlocking of a plurality of panel bodies 110 together during assembly.

Sound Transmission Reduction with Thru-Holes

Figure 17:
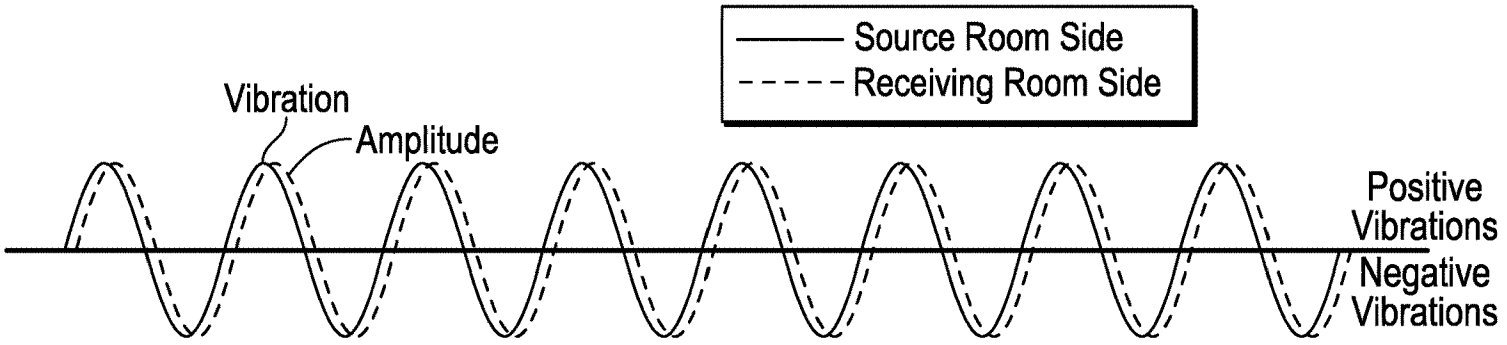
FIG. 17 is a graphical representation showing in-phase vibrations that occur between a source drywall panel and a receiving drywall panel in accordance with one aspect of the wall assembly of FIG. 1.
Figure 18:
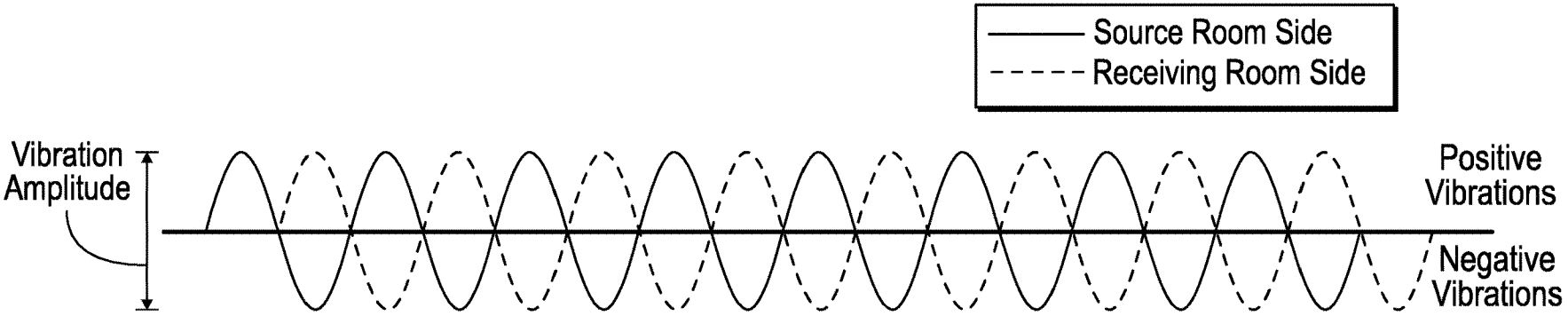
FIG. 18 is a graphical representation showing out-of-phase vibrations that occur between a source drywall panel and a receiving drywall panel in a prior art wall assembly.

As illustrated in FIGS. 3 and 7-10, and with additional reference to 16 and 17, the panel body 110 defines the plurality of thru-holes 117 formed throughout the panel body 110 that are configured to reduce sound transmission, for example, in the 250-400 Hz range, by breaking up mechanically coupled paths through the low-density EPS of the panel body 110. Specifically, the thru-holes 117 act to reduce the number of mechanically coupled paths through the assembled acoustic panel 102 to disrupt mechanical coupling of a transmitted sound wave between the front side 111 and the rear side 112 of the panel body 110, as well as even out pressure applied on either side of the panel body 110 by the transmitted sound wave through the wall assembly 100. For example, a sound wave transmitted through the first drywall panel 106A can travel through the panel body 110 of the acoustic panel 102, including the grid array of thru-holes 117, which act to break low-density mechanically coupled pathways and effectively reduce the number of mechanically coupled pathways through the panel body 110, which reduces the total sound transmission through the panel body 110 of the acoustic panel 102. The dead "air space" created by the thru-holes 117 through the panel body 110 act to reduce an internal pressure differential and vibration phase shift generated between the source side (e.g., first drywall panel 106A) and the receiving side (e.g., second drywall panel 106B) of the transmitted sound wave through the wall assembly 100. As such, transmission of the sound waves through the thru-holes 117 cause the first drywall panel 106A to vibrate in-phase with the second drywall panel 106B as demonstrated in the graphical representation of FIG. 17. In contrast, the graphical representation of FIG. 18 shows acoustic analysis of a prior art wall assembly in which a second drywall panel was shown to vibrate out-of-phase with a first drywall panel, thereby producing undesirable higher amplitude vibrations through the second drywall panel. By disrupting the large flat panel surface of the panel body 110 with a plurality of thru-holes 117, the effective surface area of the panel body 110 is reduced which also results in less vibration and out-of-phase resonance between the first and second drywall panels 106A and 106B caused by a sound wave being transmitted through the wall assembly 100. In another aspect, the second drywall panel 106B may be the source side, while the first drywall panel 106A may be the receiving side.

In one aspect, the plurality of thru-holes 117 are formed completely through the panel body 110. In one possible arrangement, the plurality of thru-holes 117 are formed in a grid array of columns and rows, although the thru-holes 117 may be formed through the panel body 110 in other symmetrical or asymmetrical arrangements. In the present embodiment, the panel body 110 may define a grid array arrangement of three columns of sixteen rows consisting of 16 thru-holes 117 for a total of 48 thru-holes 117, although other arrangements of the thru-holes 117 are contemplated. As shown, the plurality of thru-holes 117 do not cross or intrude upon the rigid internal structure 140.

In some embodiments, the panel body 110 may have a length of 48 inches, a height of 120 inches and a thickness t (FIG. 7) of about 8 inches. In some embodiments, each thru-hole 117 may have a diameter d (FIG. 7) of 4 inches and a length of 8 inches that extends completely through the panel body 110. In one aspect, the diameter d of each thru-hole 117 may be equal to half the thickness t of the panel body 110. In some embodiments, each column of thru-holes 117 in the grid array may be spaced apart by about 12 inches and each thru-hole 117 in any particular column may be spaced about 6 inches from an adjacent thru-hole 117 in that same column in the grid array of thru-holes 117 formed through the panel body 110.

Maintaining Structural Integrity

Referring to FIGS. 3-11, 14 and 15, as noted above the plurality of reinforcement strips 104A-104D provide a means for reinforcing the panel body 110 of the acoustic panel 102. In some embodiments, referring directly to FIG. 6, each reinforcement strip 104 of the plurality of reinforcement strips 104A-104D defines an elongated strip body 122 that forms a base portion 123 with an insert portion 124 having a plurality of tab portions 125 extending laterally from the middle of the base portion 123 in juxtaposition with a plurality of angled flange portions 127 bent laterally at a perpendicular angle relative to the tab portions 125. During manufacture and/or assembly, each reinforcement strip 104 may be inserted through a respective vertical slit 121 of the plurality of vertical slits 121A-121D of the panel body 110 to position each tab portion 125 and angled flange portion 127 within a respective vertical void 120 of the plurality of vertical voids 120A-120D. The base portion 123 is flush against the exterior of the panel body 110 and each angled flange portion 127 is bent at a perpendicular angle relative to the tab portion 125. In some embodiments, a plurality of openings 126 may be formed along the insert portion 124 which can reduce an overall weight of the reinforcement strip 104 and enable passage of electrical wiring through the of the acoustic panel 102.

Upon full disposal of each reinforcement strip 104 of the plurality of reinforcement strips 104A-104D through the corresponding vertical slit 121 of the plurality of vertical slits 121A-121D and in communication with a vertical void 120 of the plurality of vertical voids 120A-120D, concrete or other bonding material may be poured into each respective vertical void 120 to bond the associated reinforcement strip 104 to the panel body 110 and form the rigid internal structure 140 (FIGS. 12-15). In some embodiments, two reinforcement strips 104A and 104C may be engaged to the vertical slits 121A and 121C formed along the front side 111 of the panel body 110 and two reinforcement strips 104B and 104D may be engaged to the vertical slits 121B and 121D formed along the rear side 112 of the panel body 110.

In particular, the top side 115 defines a first projecting portion 131 associated with the front side 111 of the acoustic panel 102, a second projecting portion 132 associated with the rear side 112 of the acoustic panel 102, and the top horizontal void 118 defined between the first projecting portion 131 and the second projecting portion 132. The first top track 109A engages the first projecting portion 131 and the second top track 109B engages the second projecting portion 132 of the top side 115. The top horizontal void 118 is formed laterally through the panel body 110 such that concrete or other bonding material may be poured into and fill up the top horizontal void 118 during assembly to form a top horizontal beam 142 (FIGS. 12 and 13) of the rigid internal structure 140.

Similarly, the bottom side 116 defines a first projecting portion 133 associated with the front side 111 of the acoustic panel 102, a second projecting portion 134 associated with the rear side 112 of the acoustic panel 102, and the bottom horizontal void 119 defined between the first projecting portion 133 and the second projecting portion 134. The bottom track 108 engages the first and second projecting portions 133 and 134 of the bottom side 116. The bottom horizontal void 119 is formed laterally through the panel body 110 such that that concrete or other bonding material may be poured into and fill up the bottom horizontal void 119 during assembly to form the bottom horizontal beam 144 (FIGS. 12 and 13) of the rigid internal structure 140.

Figure 14:
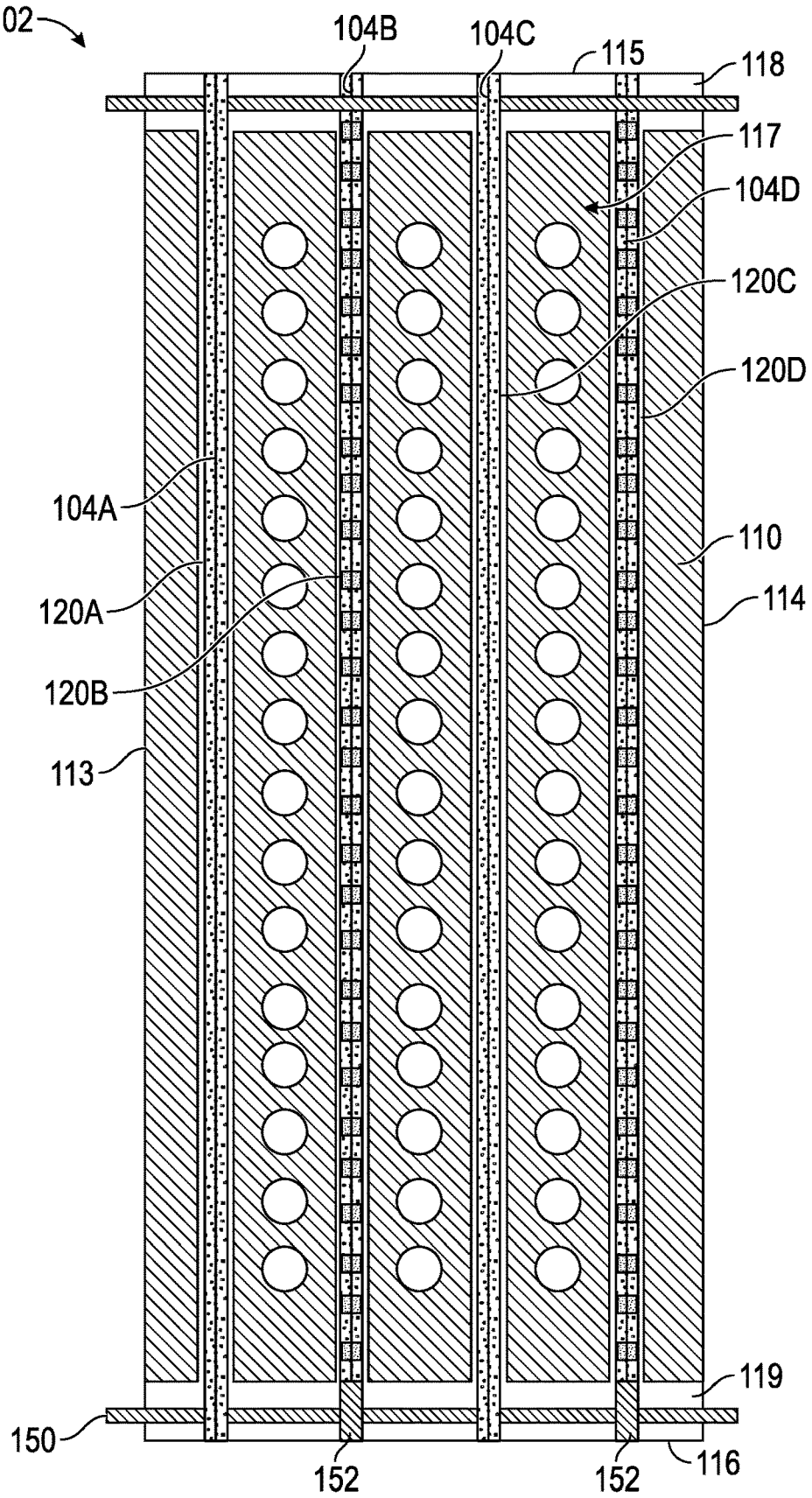
FIG. 14 is a front cutaway view showing the acoustic panel of FIG. 1 with voids to receive material for the internal concrete pillars.
Figure 15:
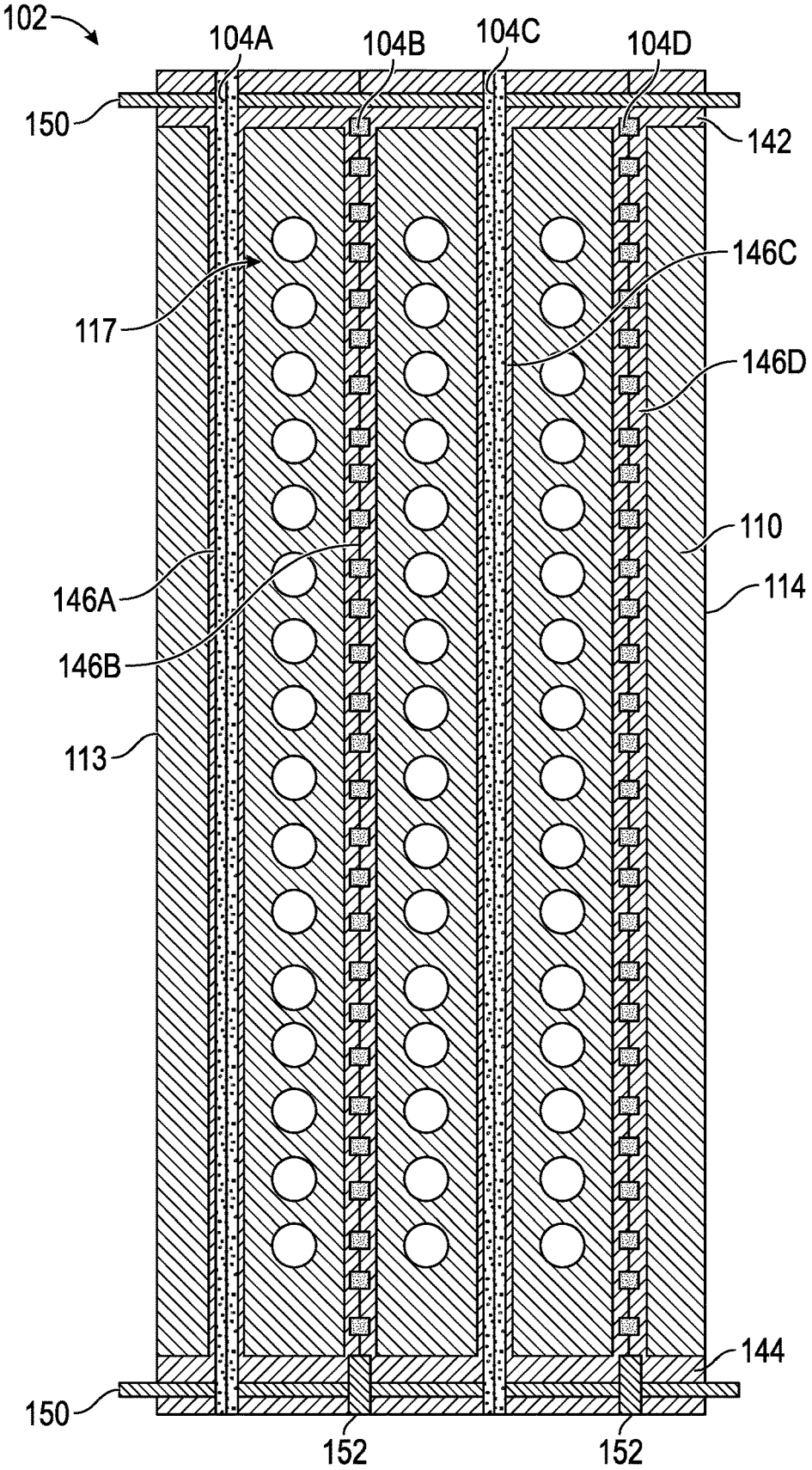
FIG. 15 is a front cutaway view showing the acoustic panel of FIG. 14 with internal concrete pillars.

In some embodiments shown in FIGS. 14 and 15, the top horizontal void 118 can include a horizontally-oriented rebar support 150 that is enveloped within the concrete or other bonding material to add structural reinforcement to the rigid internal structure 140 of the wall assembly 100. Optionally, the bottom horizontal void 119 can also include a horizontally-oriented rebar support 150, however other embodiments are also contemplated that do not require placement of the horizontally-oriented rebar support 150 within the bottom horizontal void 119. Additionally, one or more vertically-oriented rebar supports 152 can extend into the bottom horizontal void 119 and are enveloped within the concrete or other bonding material to add structural reinforcement to the wall assembly 100.

Referring specifically to FIGS. 7 and 10-15, the panel body 110 defines the plurality of vertical voids 120A-120D longitudinally formed between the top side 115 and the bottom side 116 and are each configured to receive a tab portion of a respective reinforcement strip 104A-104D therein through vertical slits 121A-121D formed longitudinally through the panel body 110 such that concrete or other bonding material may be poured into and fill up each respective vertical void 120A-120D during assembly to bond the reinforcement strips 104A-104D to the acoustic panel 102. As shown, concrete or other bonding material poured within the vertical voids 120A-120D become a plurality of pillars 146A-146D that encapsulate the reinforcement strips 104A-104D and provide structural reinforcement to the wall assembly 100. The pillars 146A-146D are connected by top and bottom horizontal beams 142 and 144 to form the rigid internal structure 140. As shown, the rigid internal structure 140 does not cross or intrude upon the plurality of thru-holes 117, as the plurality of thru-holes 117 provide "dead space" between the first and second drywall panels 106A and 106B.

Method of Manufacture and Assembly

Figure 16:
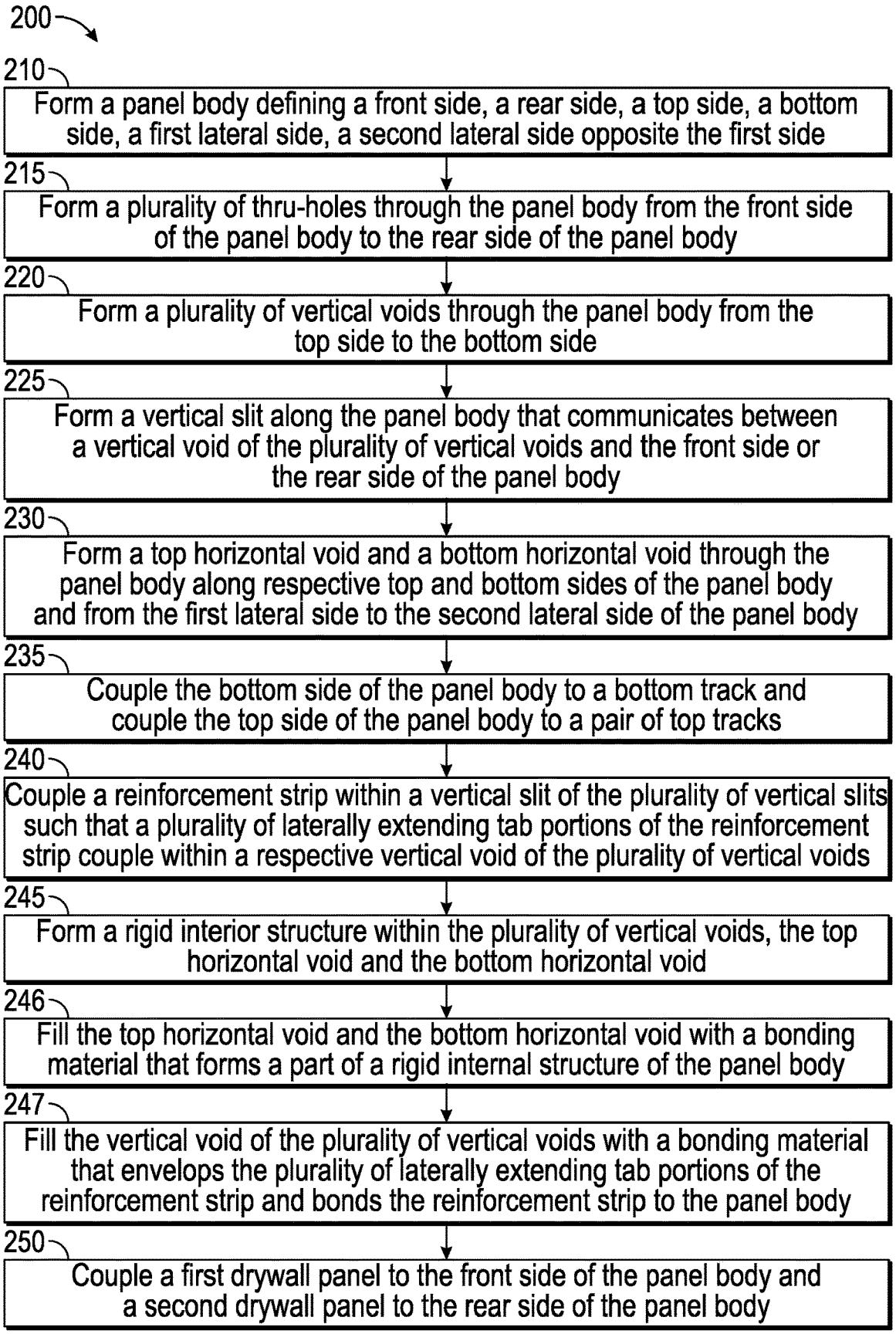
FIG. 16 is a simplified diagram showing a method of manufacture and/or assembly of the wall assembly of FIG. 1.

FIG. 16 illustrates a method 200 of manufacture and/or assembly of the wall assembly 100. Block 210 describes forming a panel body defining a front side, a rear side, a top side, a bottom side, a first lateral side, a second lateral side opposite the first lateral side. Block 215 shows forming a plurality of thru-holes through the panel body from the front side of the panel body to the rear side of the panel body. Block 220 includes forming a plurality of vertical voids through the panel body from the top side to the bottom side. Block 225 describes forming a vertical slit along the panel body that communicates between a vertical void of the plurality of vertical voids and the front side or the rear side of the panel body. Block 230 shows forming a top horizontal void and a bottom horizontal void through the panel body along respective top and bottom sides of the panel body and from the first lateral side to the second lateral side of the panel body. At block 235, the method 200 includes coupling the bottom side of the panel body to a bottom track and couple the top side of the panel body to a pair of top tracks. Block 240 describes coupling a reinforcement strip within a vertical slit of the plurality of vertical slits such that a plurality of laterally extending tab portions of the reinforcement strip couple within a respective vertical void of the plurality of vertical voids. At block 245, the method 200 shows forming a rigid interior structure within the plurality of vertical voids, the top horizontal void and the bottom horizontal void. Block 245 includes a first sub-step at block 246 which includes filling the top horizontal void and the bottom horizontal void with a bonding material that forms a part of a rigid internal structure of the panel body, and a second sub-step at block 247 which includes filling the vertical void of the plurality of vertical voids with a bonding material that envelops the plurality of laterally extending tab portions of the reinforcement strip and bonds the reinforcement strip to the panel body. At block 250, the method 200 includes coupling a first drywall panel to the front side of the panel body and a second drywall panel to the rear side of the panel body.

Testing

Sound Transmission Class (STC) is an integer rating of how well a building partition, for example a wall assembly, attenuates airborne sound. Transmission Loss (TL) is a measurement of the decibel dB (volume) difference on either side of a wall assembly. STC is calculated by taking the Transmission Loss values tested at 16 standard frequencies over a range of between 125 Hz to 4000 Hz and plotting these values on a graph. For every 10 STC points increased, the sound transmission is reduced by 50%. As an example, a typical 2×4 stud wall with fiberglass and one layer of ⅝" drywall on each side has an STC 34 rating, while the wall assembly 100 with the acoustic panel 102 with one layer of ⅝" drywall on each side has an STC 46 rating. This dramatic increase of 12 STC points reduces the sound transmission by approximately 60% by the wall assembly 100 with the acoustic panel 102.

During testing, a number of panel bodies 110 were tested per ASTM E90 Standard Test Method for Laboratory Measurement of Airborne Sound Transmission Loss of Building Partitions and Elements using two adjacent reverberation rooms which were arranged with an opening between them in which a test partition was installed. An approximately diffuse sound field was produced in one room using a multi-frequency signal generator connected as an input to an amplifier which was in turn connected to a loudspeaker. This was designated the source room. Sound incident on the test partition caused it to vibrate and create a sound field in the second room and the area of the specimen was used to calculate transmission loss. Because transmission loss is a function of frequency, measurements were made in a series of frequency bands.

Figure 19A:
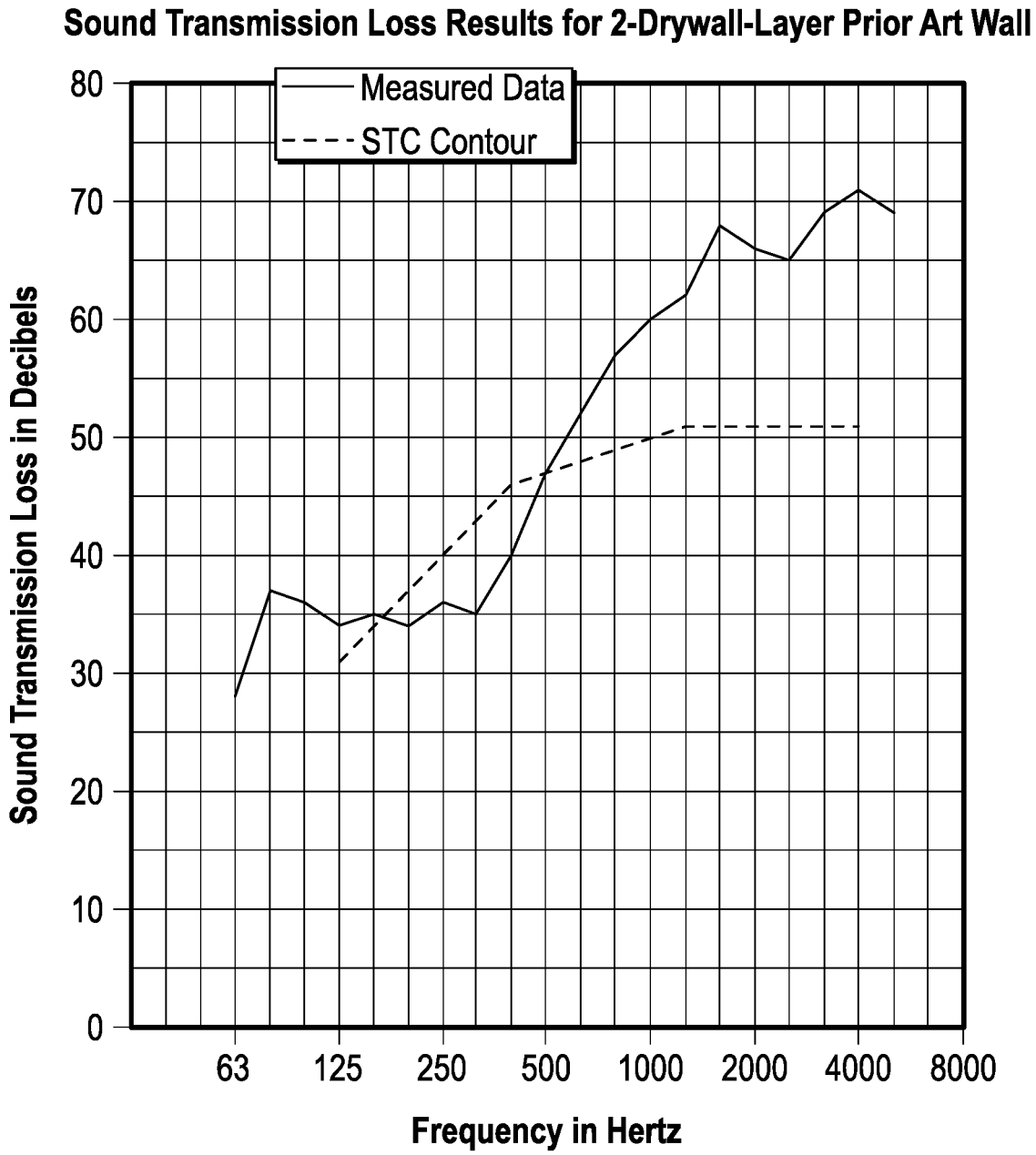
FIGS. 19A-19C are a series of graphical representations showing sound transmission loss results for a prior wall assembly and two wall assemblies according to FIG. 1 featuring a type C drywall and a type X drywall and having two layers of drywall on each side.
Figure 19B:
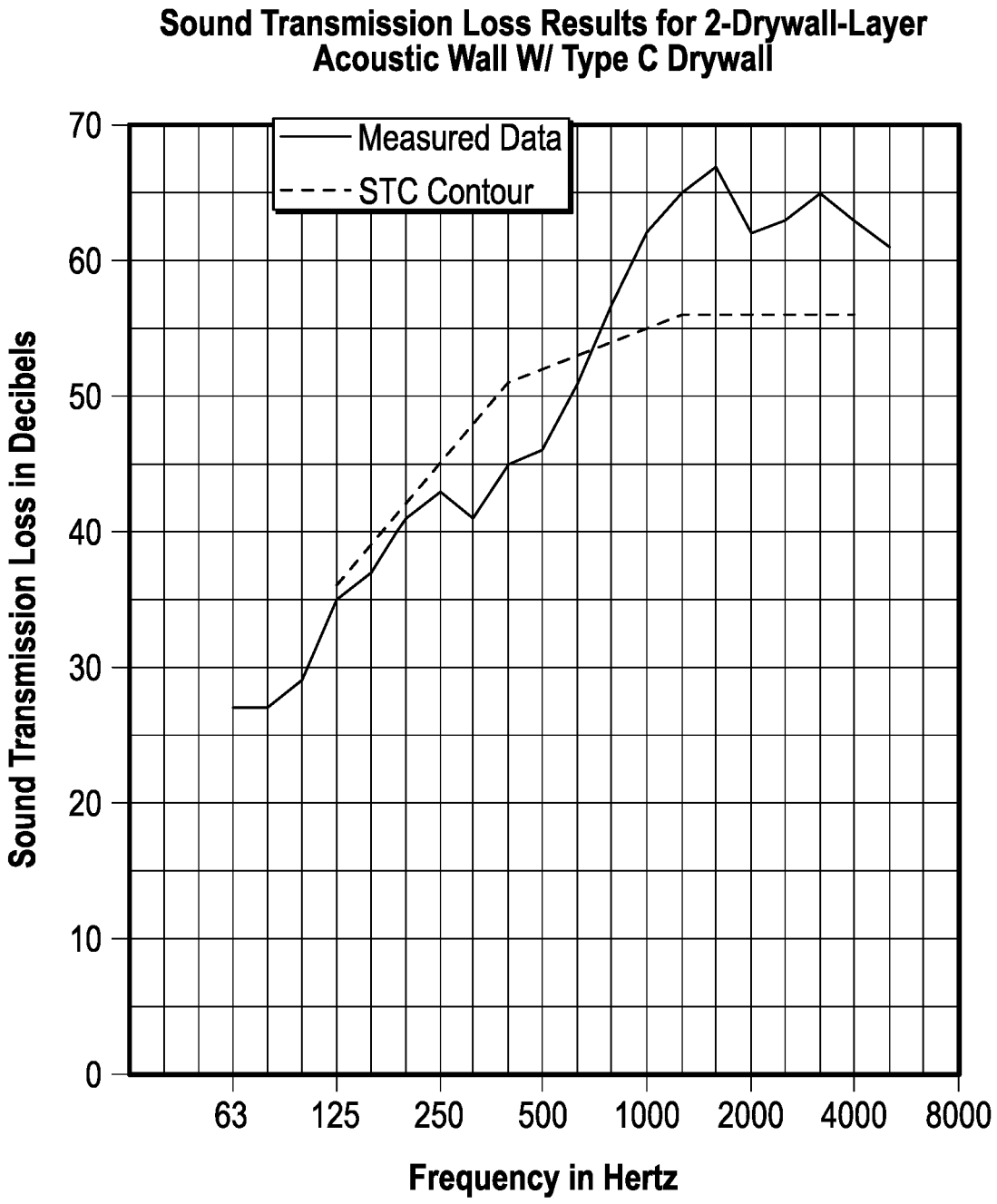
Figure 19C:
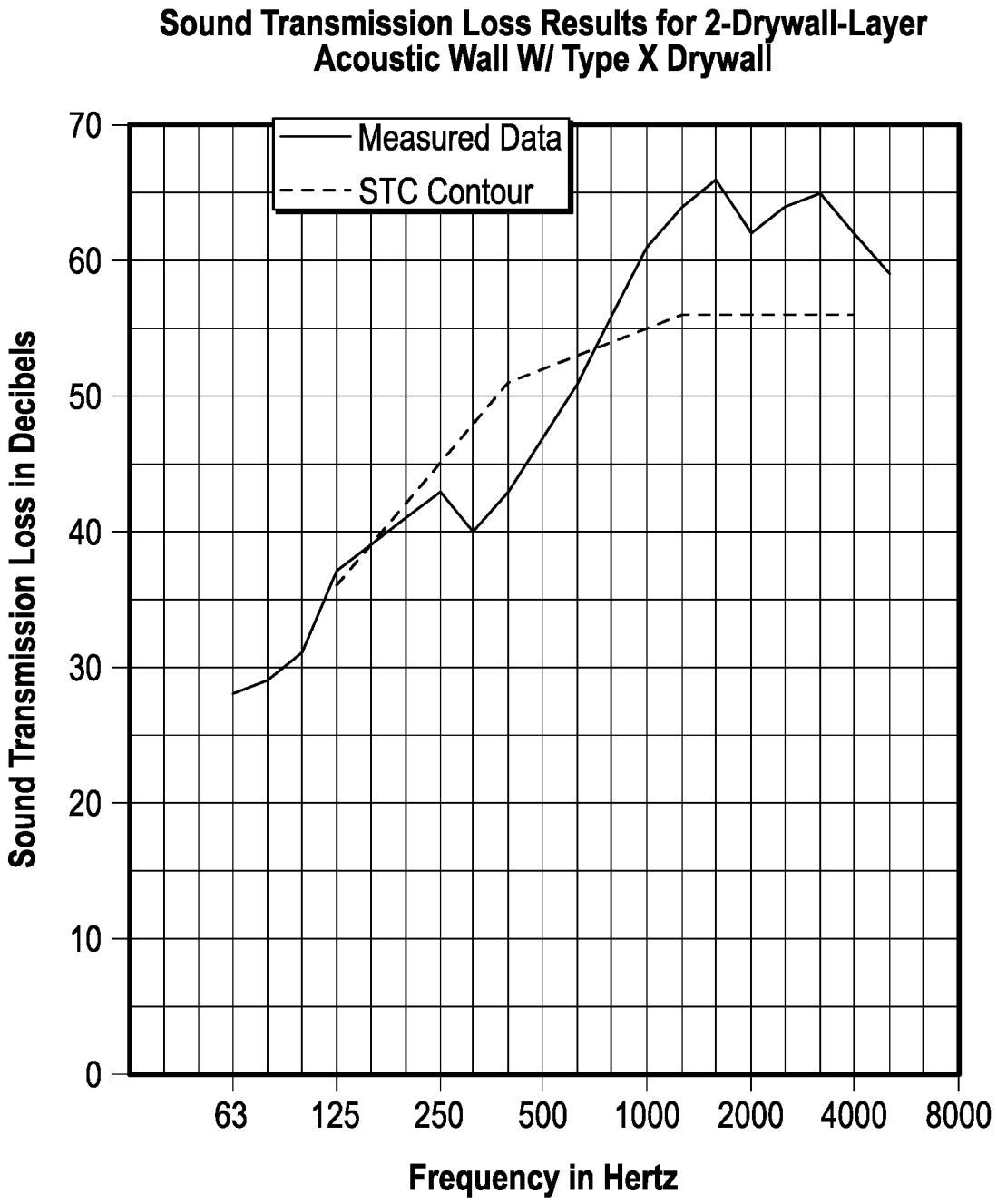
Figure 20A:
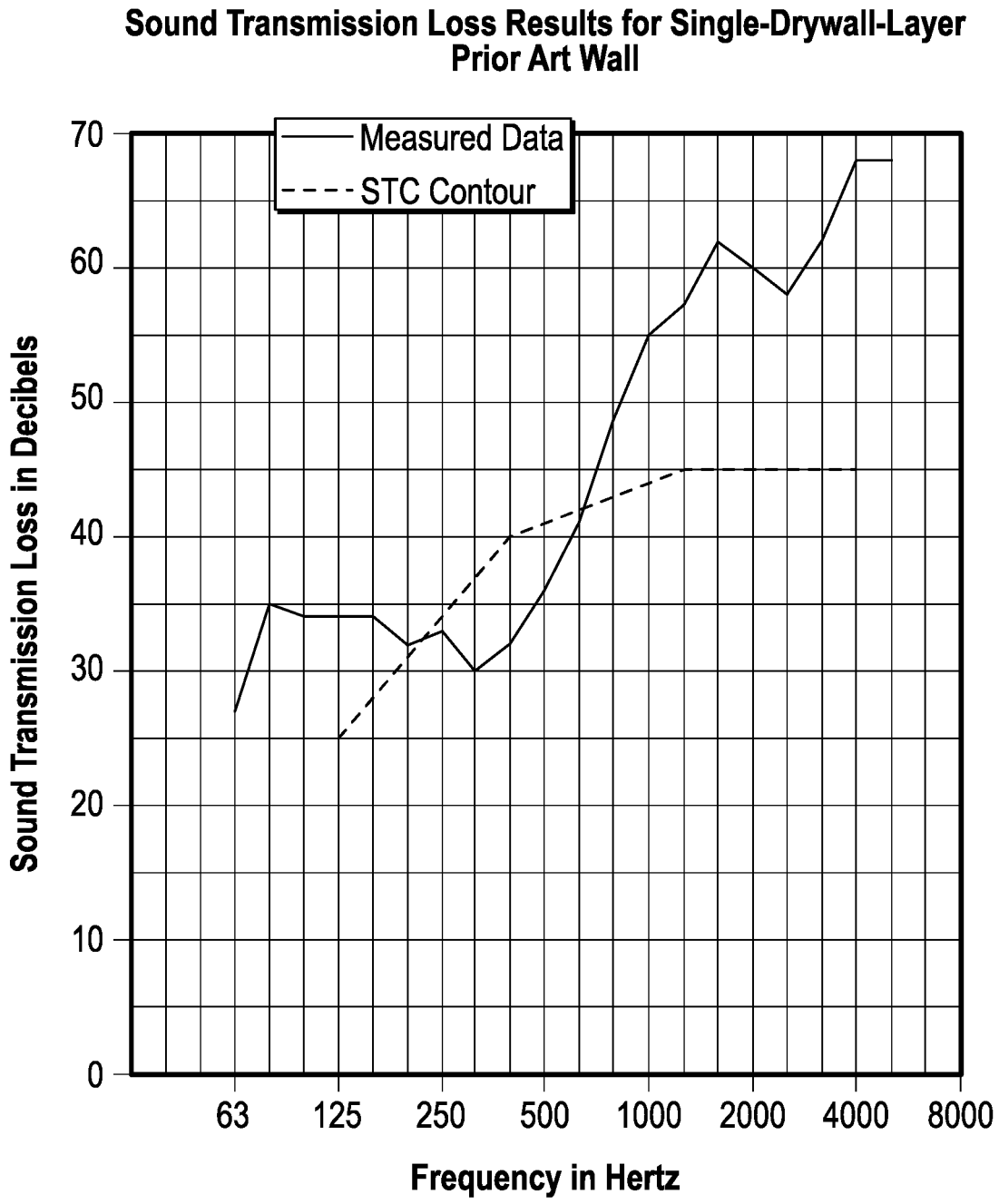
FIGS. 20A and 20B are a series of graphical representations showing sound transmission loss results for a prior wall assembly and a wall assembly according to FIG. 1 featuring a type X drywall and having a single layer of drywall on each side.
Figure 20B:
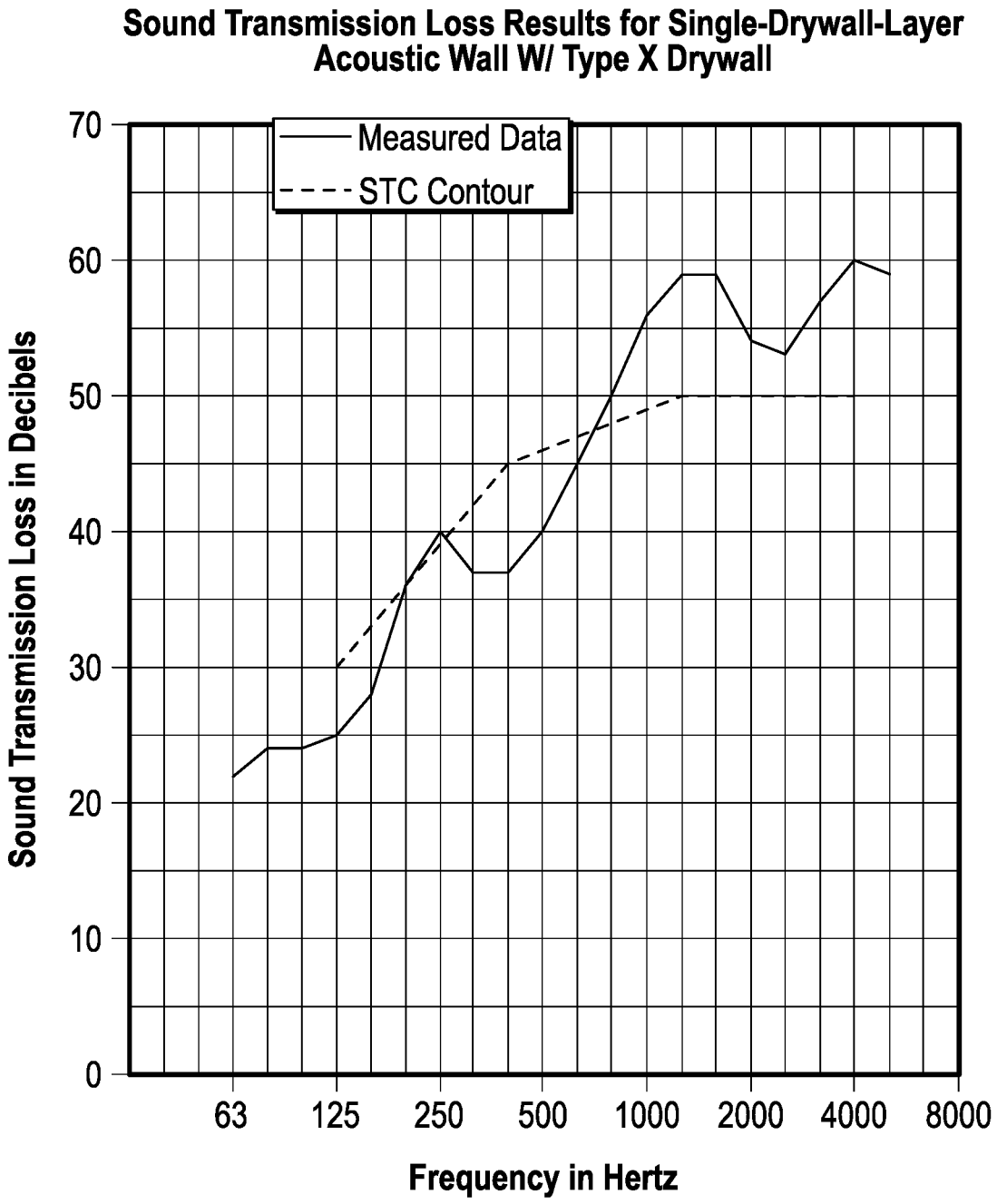

The below Tables 1-5 provide various test results of the wall assembly 100 with the acoustic panel 102 with respect to a prior wall assembly similar to the wall assembly 100 but featuring a solid EPS panel body rather than the acoustic panel 102. Sound transmission loss in decibels (dB) is correspondingly plotted in FIGS. 19A-20B. In particular, Tables 1-3 show sound transmission loss for a prior wall (corresponding with FIG. 19A), the wall assembly 100 featuring a type C drywall (corresponding with FIG. 19B), and the wall assembly 100 featuring a type X drywall (corresponding with FIG. 19C), each with 2 layers of drywall on each side. For the prior art wall of Table 1 and FIG. 19A, an Outdoor-Indoor Transmission Class rating in accordance with ASTM E 1332-10a was OITC-41 and a Sound Transmission Class rating in accordance with ASTM E 413-10 was STC-41. For the wall assembly 100 featuring type C drywall of Table 2 and FIG. 19B, an Outdoor-Indoor Transmission Class rating in accordance with ASTM E 1332-10a was OITC-41 and a Sound Transmission Class rating in accordance with ASTM E 413-10 was STC-52. For the wall assembly 100 featuring type X drywall of Table 3 and FIG. 19C, an Outdoor-Indoor Transmission Class rating in accordance with ASTM E 1332-10a was OITC-43 and a Sound Transmission Class rating in accordance with ASTM E 413-10 was STC-52.

Tables 4 and 5 show sound transmission loss for a prior wall (corresponding with FIG. 20A) and the wall assembly 100 featuring a type X drywall (corresponding with FIG. 20B), each with 1 layer of drywall on each side. For the prior art wall of Table 4 and FIG. 20A, an Outdoor-Indoor Transmission Class rating in accordance with ASTM E 1332-10a was OITC-37 and a Sound Transmission Class rating in accordance with ASTM E 413-10 was STC-41. For the wall assembly 100 featuring type X drywall of Table 5 and FIG. 20B, an Outdoor-Indoor Transmission Class rating in accordance with ASTM E 1332-10a was OITC-35 and a Sound Transmission Class rating in accordance with ASTM E 413-10 was STC-46.

TABLE 1

Sound Transmission Loss for 2-Drywall-Layer Prior Art Wall (no thru-holes)

| | | | | | | | | | | |
|---|---|---|---|---|---|---|---|---|---|---|
| 1/3 Oct BAND CTR FREQ | 63 | 80 | 100 | 125 | 160 | 200 | 250 | 315 | 400 | 500 |
| TL in dB | 28* | 37* | 36 | 34 | 35 | 34 | 36 | 35 | 40 | 47 |
| 95% confidence in dB | 1.42 | 1.92 | 2.07 | 1.47 | 0.89 | 0.76 | 0.80 | 0.52 | 0.36 | 0.38 |
| deficiencies | | | | | | (3) | (4) | (8) | (6) | (0) |
| 1/3 Oct BAND CTR FREQ | 630 | 800 | 1000 | 1250 | 1600 | 2000 | 2500 | 3150 | 4000 | 5000 |
| TL in dB | 52 | 57 | 60 | 62 | 68 | 66 | 65 | 69 | 71 | 69 |
| 95% confidence in dB | 0.29 | 0.44 | 0.38 | 0.39 | 0.36 | 0.56 | 0.55 | 0.31 | 0.32 | 0.5 |
| deficiencies | | | | | | | | | | |
| EWR | 47 | | OITC | 41 | | STC | 47 (21) | | | |

TABLE 2

Sound Transmission Loss for 2-Drywall-Layer Acoustic Panel Wall with Type C drywall

| | | | | | | | | | | |
|---|---|---|---|---|---|---|---|---|---|---|
| 1/3 Oct BAND CTR FREQ | 63 | 80 | 100 | 125 | 160 | 200 | 250 | 315 | 400 | 500 |
| TL in dB | 27 | 27 | 29 | 35 | 37 | 41 | 43 | 41 | 45 | 46 |
| 95% confidence in dB | 1.42 | 1.92 | 2.07 | 1.47 | 0.89 | 0.76 | 0.80 | 0.52 | 0.36 | 0.38 |
| deficiencies | | | | (1) | (2) | (1) | (2) | (7) | (6) | (0) |
| 1/3 Oct BAND CTR FREQ | 630 | 800 | 1000 | 1250 | 1600 | 2000 | 2500 | 3150 | 4000 | 5000 |
| TL in dB | 51 | 57 | 62 | 65 | 67 | 62 | 63 | 65 | 63 | 61 |
| 95% confidence in dB | 0.29 | 0.44 | 0.38 | 0.39 | 0.36 | 0.56 | 0.55 | 0.31 | 0.32 | 0.5 |
| deficiencies | (2) | | | | | | | | | |
| EWR | 51 | | OITC | 41 | | STC | 52 (27) | | | |

TABLE 3

| Sound Transmission Loss for 2-Drywall-Layer Acoustic Panel Wall with Type X drywall | | | | | | | | | | |
|---|---|---|---|---|---|---|---|---|---|---|
| 1/3 Oct BAND CTR FREQ | 63 | 80 | 100 | 125 | 160 | 200 | 250 | 315 | 400 | 500 |
| TL in dB | 28 | 29 | 31 | 37 | 39 | 41 | 43 | 40 | 43 | 47 |
| 95% confidence in dB deficiencies | 1.42 | 1.92 | 2.07 | 1.47 | 0.89 (0) | 0.76 (1) | 0.80 (2) | 0.52 (8) | 0.36 (8) | 0.38 (5) |
| 1/3 Oct BAND CTR FREQ | 630 | 800 | 1000 | 1250 | 1600 | 2000 | 2500 | 3150 | 4000 | 5000 |
| TL in dB | 51 | 56 | 61 | 64 | 66 | 62 | 64 | 65 | 62 | 59 |
| 95% confidence in dB deficiencies | 0.29 (2) | 0.44 | 0.38 | 0.39 | 0.36 | 0.56 | 0.55 | 0.31 | 0.32 | 0.5 |
| EWR | 51 | | OITC | 43 | | STC | 52 (27) | | | |

TABLE 4

| Sound Transmission Loss for 1-Drywall-Layer Prior Art Wall (no thru-holes) | | | | | | | | | | |
|---|---|---|---|---|---|---|---|---|---|---|
| 1/3 Oct BAND CTR FREQ | 63 | 80 | 100 | 125 | 160 | 200 | 250 | 315 | 400 | 500 |
| TL in dB | 27* | 35* | 34 | 34 | 34 | 32 | 33 | 30 | 32 | 36 |
| 95% confidence in dB deficiencies | 1.42 | 1.92 | 2.07 | 1.47 | 0.89 | 0.76 | 0.80 (1) | 0.52 (7) | 0.36 (8) | 0.38 (5) |
| 1/3 Oct BAND CTR FREQ | 630 | 800 | 1000 | 1250 | 1600 | 2000 | 2500 | 3150 | 4000 | 5000 |
| TL in dB | 41 | 49 | 55 | 57 | 62 | 60 | 58 | 62 | 68 | 68 |
| 95% confidence in dB deficiencies | 0.29 (1) | 0.44 | 0.38 | 0.39 | 0.36 | 0.56 | 0.55 | 0.31 | 0.32 | 0.5 |
| EWR | 42 | | OITC | 37 | | STC | 41 (22) | | | |

40

TABLE 5

| Sound Transmission Loss for 1-Drywall-Layer Acoustic Panel Wall with Type X drywall | | | | | | | | | | |
|---|---|---|---|---|---|---|---|---|---|---|
| 1/3 Oct BAND CTR FREQ | 63 | 80 | 100 | 125 | 160 | 200 | 250 | 315 | 400 | 500 |
| TL in dB | 22 | 24 | 24 | 25 | 28 | 36 | 40 | 37 | 37 | 40 |
| 95% confidence in dB deficiencies | 1.42 | 1.92 | 2.07 | 1.47 (5) | 0.89 (5) | 0.76 (0) | 0.80 | 0.52 (5) | 0.36 (8) | 0.38 (6) |
| 1/3 Oct BAND CTR FREQ | 630 | 800 | 1000 | 1250 | 1600 | 2000 | 2500 | 3150 | 4000 | 5000 |
| TL in dB | 45 | 50 | 56 | 59 | 59 | 54 | 53 | 57 | 60 | 59 |
| 95% confidence in dB deficiencies | 0.29 (2) | 0.44 | 0.38 | 0.39 | 0.36 | 0.56 | 0.55 | 0.31 | 0.32 | 0.5 |
| EWR | 45 | | OITC | 35 | | STC | 46 (31) | | | |

In particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A method, comprising:

forming a panel body defining a front side, a rear side, a top side, a bottom side, a first lateral side, a second lateral side opposite the first lateral side;

forming a plurality of thru-holes through the panel body from the front side of the panel body to the rear side of the panel body;

forming a plurality of vertical voids through the panel body from the top side to the bottom side;

forming a vertical slit along the panel body that communicates between a vertical void of the plurality of vertical voids and the front side or the rear side of the panel body; and coupling a reinforcement strip within the vertical slit such that a plurality of laterally extending tab portions of the reinforcement strip couple within a respective vertical void of the plurality of vertical voids.

2. The method of claim 1, further comprising:

filling at least one vertical void of the plurality of vertical voids with a bonding material that envelops the plurality of laterally extending tab portions of the reinforcement strip and bonds the reinforcement strip to the panel body.

3. The method of claim 1, further comprising:

forming a top horizontal void through the panel body along the top side of the panel body and from the first lateral side to the second lateral side of the panel body; and forming a bottom horizontal void through the panel body along the bottom side of the panel body and from the first lateral side to the second lateral side of the panel body.

4. The method of claim 3, further comprising:

filling the top horizontal void and the bottom horizontal void with a bonding material that forms a part of a rigid internal structure of the panel body.

5. The method of claim 1, further comprising:

coupling a first drywall panel to the front side of the panel body and a second drywall panel to the rear side of the panel body.

* * * * *